US008432354B2

(12) United States Patent
Gao

(10) Patent No.: US 8,432,354 B2
(45) Date of Patent: Apr. 30, 2013

(54) BACKLIGHT CONTROL CIRCUIT WITH A PULSE WIDTH MODULATED GENERATOR

(75) Inventor: Ming Gao, Shenzhen (CN)

(73) Assignees: Innocom Technology (Shenzhen) Co., Ltd., Shenzhen (CN); Chimei Innolux Corporation, Miaoli County (TW)

( * ) Notice: Subject to any disclaimer, the term of this patent is extended or adjusted under 35 U.S.C. 154(b) by 484 days.

(21) Appl. No.: 12/762,376

(22) Filed: Apr. 19, 2010

(65) Prior Publication Data

US 2011/0057969 A1 Mar. 10, 2011

(51) Int. Cl.
*G09G 3/36* (2006.01)

(52) U.S. Cl.
USPC ..... 345/102

(58) Field of Classification Search ..... 345/102; 327/143
See application file for complete search history.

(56) References Cited

U.S. PATENT DOCUMENTS

| | | | | |
|---|---|---|---|---|
| 5,633,651 | A * | 5/1997 | Carvajal et al. | 345/82 |
| 7,825,919 | B2 * | 11/2010 | Woo et al. | 345/211 |
| 2003/0084418 | A1 * | 5/2003 | Regan | 716/14 |
| 2007/0171182 | A1 * | 7/2007 | Mizuno et al. | 345/102 |
| 2010/0283791 | A1 * | 11/2010 | Lin et al. | 345/522 |
| 2011/0018914 | A1 * | 1/2011 | Ishikawa et al. | 345/691 |

* cited by examiner

*Primary Examiner* — Chanh Nguyen
*Assistant Examiner* — Jonathan Blancha
(74) *Attorney, Agent, or Firm* — WPAT, PC; Justin King

(57) ABSTRACT

A backlight control circuit includes a logic unit, a drive unit, a decoder, a current setting unit, a current stabilizer, a pulse width modulated generator, a plurality of light sources, and a control unit. The control unit controls the brightness of each light source according to the pulse width modulated signals from the pulse width modulated generator. The logic unit sends an enable signal to the control unit. The drive unit sends a first control signal to the decoder. According to a decoded signal from the decoder, the current setting unit sends a second control signal and an output voltage to the current stabilizer, the current stabilizer generates a steady current. According to the second control signal, the control unit selectively provides the steady current to the corresponding light source.

9 Claims, 1 Drawing Sheet

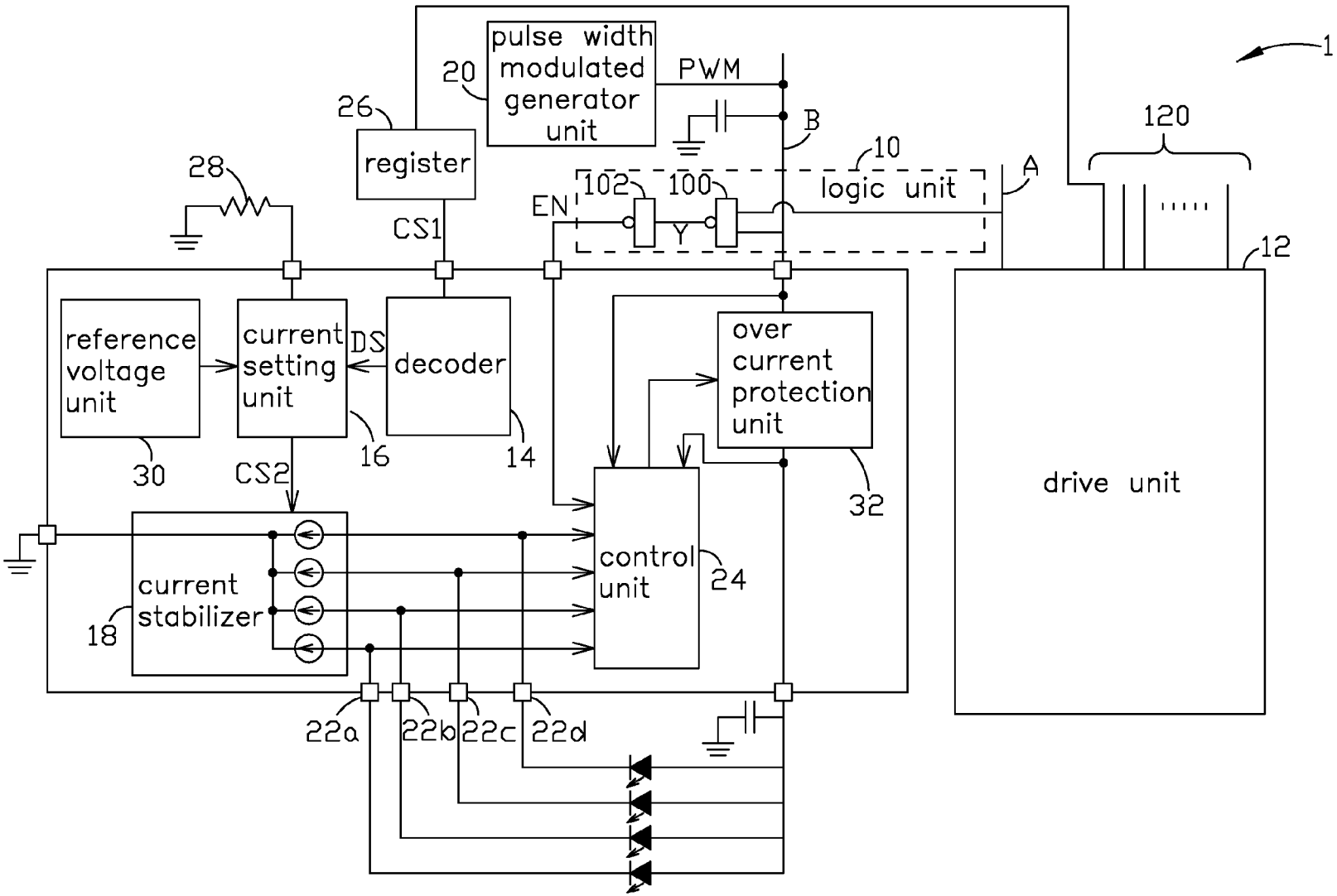
1
120
12
drive unit
A
10
logic unit
B
PWM
100
Y
102
EN
pulse width modulated generator unit
20
register
26
CS1
decoder
14
DS
current setting unit
16
CS2
reference voltage unit
30
28
over current protection unit
32
control unit
24
current stabilizer
18
22a
22b
22c
22d

BACKLIGHT CONTROL CIRCUIT WITH A PULSE WIDTH MODULATED GENERATOR

BACKGROUND

1. Technical Field

The present disclosure relates to backlight control circuits, and more particularly, to a backlight control circuit used for adjusting backlight brightness of a display.

2. Description of Related Art

A typical liquid crystal display (LCD) includes a display module, a backlight module for illuminating the display module, and a backlight control circuit for controlling the backlight module. The power supply and the control signals of the backlight module are provided by an external circuit, and the power supply and the control signals of the backlight module are input to a drive unit of the display module. The power supply and the control signals of the backlight module cannot be directly controlled by the drive unit. The backlight module may not be synchronized with the display module, if the power supply of the display module is turned off, the power supply of the backlight module is still on, and then a residual image is displayed.

Therefore, it is desired to provide a backlight control circuit which can overcome the above-described deficiencies.

BRIEF DESCRIPTION OF THE DRAWING

Many aspects of the present backlight control circuit can be better understood with reference to the following drawing. The components in the drawing are not necessarily drawn to scale, the emphasis instead being placed upon clearly illustrating the principles of the present backlight control circuit.

The drawing is a block diagram of a backlight control circuit according to one embodiment of the present disclosure.

DETAILED DESCRIPTION

Reference is now made to the drawing to describe one embodiment of the present disclosure in detail.

Referring to the drawing, a backlight control circuit 1 includes a logic unit 10, a drive unit 12, a decoder 14, a current setting unit 16, a current stabilizer 18, a pulse width modulated generator (PWM) 20, four light sources 22*a*, 22*b*, 22*c*, 22*d*, and a control unit 24. The drive unit 12 is connected to the logic unit 10. The logic unit 10, the current stabilizer 18, the PWM 20, and the light sources 22*a*, 22*b*, 22*c*, 22*d* are connected to the control unit 24. The decoder 14 is connected to the current stabilizer 18 through the current setting unit 16. It should be understood that the number of the light sources can be set according to an actual situation, and is not limited to the embodiment.

The logic unit 10 includes a NAND gate 100 and a NOT gate 102. The NAND gate 100 and the NOT gate 102 are connected in series. The NAND gate 100 receives a display module power supply signal A from the drive unit 12 and a backlight power supply signal B from an external circuit, and sends an intermediate signal Y to the NOT gate 102. The NOT gate 102 receives the intermediate signal Y and sends an enable signal EN to the control unit 24. The logical relationships between the above-described signals are summarized in the following table.

| A | B | $Y = \overline{AB}$ | $EN = \overline{Y}$ |
|---|---|---|---|
| 0 | 0 | 1 | 0 |
| 0 | 1 | 1 | 0 |
| 1 | 0 | 1 | 0 |
| 1 | 1 | 0 | 1 |

Referring to the table, if the display module power supply signal A or the backlight power supply signal B are at a low level, the enable signal EN is at a low level. According to the low level enable signal EN, the control unit 24 makes the light sources 22*a*, 22*b*, 22*c*, 22*d* closed. If the display module power supply signal A and the backlight power supply signal B are both at a high level, the enable signal EN is at a high level. According to the high level enable signal EN, the control unit 24 makes the light sources 22*a*, 22*b*, 22*c*, 22*d* opened. Therefore, the light sources work synchronously with the display module, and residual images can be avoided.

The PWM 20 sends PWM signals to the control unit 24. The control unit 24 controls the brightness of each light source according to the PWM signals.

The drive unit 12 includes a plurality of pins 120 for outputting various control signals. The backlight control circuit 1 may further include a register 26. The register 26 is connected to one pin 120.

The working process of the backlight control circuit 1 may include the following steps: the drive unit 12 sends a first control signal CS1 to the register 26, the register 26 receives the first control signal CS1 and sends the first control signal CS1 to the decoder 14. According to the first control signal CS1, the decoder 14 sends a decoded signal DS to the current setting unit 16. The current setting unit 16 receives the decoded signal DS and sends a second control signal CS2 to the current stabilizer 18. According to an exemplary embodiment, the backlight control circuit 1 further includes a resistor 28 and a reference voltage unit 30. The resistor 28 is connected between the current setting unit 16 and ground. The reference voltage unit 30 for generating a reference voltage is connected to the current setting unit 16. The current setting unit 16 generates an output voltage which is equal to the difference between the reference voltage and the voltage of the resistor 28. For example, if the reference voltage is about 5 volts, and the voltage of the resistor 28 is about 3 volts, then the output voltage is will be about 2 volts.

The current stabilizer 18 receives the second control signal CS2 and the output voltage, and generates a steady current. According to the second control signal CS2, the control unit 24 selectively provides the steady current to the corresponding light source. For example, if the second control signal CS2 is [1 1 0 1], the light sources 22*a*, 22*b*, 22*d* are opened, and the light source 22*c* is closed.

According to an exemplary embodiment, the backlight control circuit 1 may further include an over current protection unit 32, the over current protection unit 32 is connected between the control unit 24 and the light sources 22*a*, 22*b*, 22*c*, 22*d*.

According to the backlight control circuit 1, the drive unit 12 can control the backlight to work synchronously with the display module, avoiding residual images. Furthermore, to save space, the backlight control circuit 1 can be integrated in the drive unit 12.

In an alternative embodiment of the present disclosure, the register 26 can be omitted, and the decoder 14 is connected to the pin 120.

It is to be further understood that even though numerous characteristics and advantages of the present embodiments have been set forth in the foregoing description, together with details of structures and functions of the embodiment, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A backlight control circuit of a display comprising:

a logic unit;

a drive unit;

a decoder;

a current setting unit;

a current stabilizer;

a pulse width modulated generator;

a plurality of light sources; and a control unit;

wherein the pulse width modulated generator sends pulse width modulated signals to the control unit, the control unit controls the brightness of each light source according to the pulse width modulated signals; the logic unit receives a display module power supply signal from the drive unit and a backlight power supply signal from an external circuit, and sends an enable signal to the control unit; the drive unit sends a first control signal to the decoder, the decoder receives the first control signal and sends a decoded signal to the current setting unit; according to the decoded signal, the current setting unit sends a second control signal and an output voltage to the current stabilizer; the current stabilizer receives the second control signal and generates a steady current; according to the second control signal, the control unit selectively provides the steady current to the corresponding light source, and wherein the logic unit includes a NAND gate and a NOT gate connected in series, the NAND gate receives the display module power supply signal and the backlight power supply signal, the NAND gate sends a intermediate signal to the NOT gate, and the NOT gate generates the enable signal according to the intermediate signal.

2. The backlight control circuit as claimed in claim 1, further including a register, wherein the register receives the first control signal and sends the first control signal to the decoder.

3. The backlight control circuit as claimed in claim 1, further including a resistor and a reference voltage unit for generating a reference voltage, wherein the resistor is connected between the current setting unit and ground, the reference voltage unit is connected to the current setting unit.

4. The backlight control circuit as claimed in claim 3, wherein the output voltage is about equal to the difference value between the reference voltage and the voltage of the resistor.

5. The backlight control circuit as claimed in claim 1, further including an over current protection unit connected between the control unit and the light sources.

6. A backlight control circuit, comprising:

a logic unit;

a drive unit connected to the logic unit;

a decoder connected to the drive unit;

a current setting unit connected to the decoder;

a current stabilizer connected to the current setting unit ;

a control unit connected to the logic unit and the current stabilizer;

a pulse width modulated generator electronically connected to the control unit; and a plurality of light sources electronically connected to the control unit wherein the pulse width modulated generator sends pulse width modulated finals to the control unit, the control unit controls the brightness of each light source according to the pulse width modulated signals; the logic unit receives a display module power supply signal from the drive unit and a backlight power supply signal from an external circuit, and sends an enable signal to the control unit; the drive unit sends a first control signal to the decoder, the decoder receives the first control signal and sends a decoded signal to the current setting unit; according to the decoded signal, the current setting unit sends a second control signal and an output voltage to the current stabilizer; the current stabilizer receives the second control signal and generates a steady current; according to the second control signal the control unit selectively provides the steady current to the corresponding light source; and wherein the logic unit includes a NAND gate and a NOT gate connected in series, the NAND gate receives the display module power supply signal and the backlight power supply signal, the NAND gate sends a intermediate signal to the NOT gate, and the NOT gate generates the enable signal according to the intermediate signal.

7. The backlight control circuit as claimed in claim 6, wherein further including a register, wherein the register is connected between the drive unit and the decoder.

8. The backlight control circuit as claimed in claim 6, further including a resistor and a reference voltage unit for generating a reference voltage, wherein the resistor is connected between the current setting unit and ground, the reference voltage unit is connected to the current setting unit.

9. The backlight control circuit as claimed in claim 8, further including an over current protection unit connected between the control unit and the light sources.

* * * * *